US006253734B1

(12) United States Patent
Rembold et al.

(10) Patent No.: US 6,253,734 B1
(45) Date of Patent: Jul. 3, 2001

(54) FUEL DELIVERY SYSTEM OF AN INTERNAL COMBUSTION ENGINE

(75) Inventors: Helmut Rembold, Stuttgart; Werner-Karl Marquardt, Markgroeningen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,503

(22) PCT Filed: May 4, 1999

(86) PCT No.: PCT/DE99/01328

§ 371 Date: Jun. 5, 2000

§ 102(e) Date: Jun. 5, 2000

(87) PCT Pub. No.: WO00/06894

PCT Pub. Date: Feb. 10, 2000

(30) Foreign Application Priority Data

Jul. 29, 1998 (DE) ..... 198 34 120

(51) Int. Cl.[7] ..... F02M 37/00
(52) U.S. Cl. ..... 123/446; 123/458
(58) Field of Search ..... 123/446, 458, 123/506, 510–511

(56) References Cited

U.S. PATENT DOCUMENTS 4,378,775 * 4/1983 Straubel et al. ..... 123/458
4,662,825 * 5/1987 Djordjevic ..... 123/506
4,884,545 * 12/1989 Mathis ..... 123/446
5,099,814 * 3/1992 Ament ..... 123/450
5,533,481 * 7/1996 Kronberger ..... 123/299
5,927,322 * 7/1999 Rosenau ..... 123/446

FOREIGN PATENT DOCUMENTS

3700358 * 7/1988 (DE) .

* cited by examiner

*Primary Examiner*—Thomas N. Moulis
(74) *Attorney, Agent, or Firm*—Ronald E. Greigg; Edwin E. Greigg

(57) ABSTRACT

A fuel delivery systems with first and second fuel pumps connected in series in which, a satisfactorily precise regulation of the fuel quantity supplied by the second fuel pump is possible. In particular, a switching time of a control valve that controls the fuel quantity is very short. The control valve includes an electromagnet which holds the valve member in a starting position. The electromagnet is supplied with just enough current that the valve member remains in this position. A slight change of the current supply of electromagnet can then cause the switching of the control valve into the end position within an extremely short period of time. The fuel delivery system is provided for an internal combustion engine of a vehicle.

20 Claims, 8 Drawing Sheets

FUEL DELIVERY SYSTEM OF AN INTERNAL COMBUSTION ENGINE

PRIOR ART

This application is being filed simultaneously with another application by the identical inventors, further identified as R.33959, PCT/DE 99/01329, U.S. Ser. No. 09/509,498.

The invention is based on a fuel delivery system for supplying fuel for an internal combustion engine.

Previously there have been fuel delivery systems in which a first fuel pump delivers fuel from a fuel tank to a second fuel pump by way of a fuel connection. The second fuel pump in turn delivers the fuel into a pressure line which is connected to at least one fuel valve. Usually, the number of fuel valves is equal to the number of cylinders of the internal combustion engine. The fuel delivery system can be designed so that the fuel valve injects the fuel directly into a combustion chamber of the internal combustion engine. During operation of this fuel delivery system, a high pressure is necessary in the pressure line that leads to the fuel valve.

Normally, the second fuel pump is mechanically driven directly by the internal combustion engine. The second fuel pump usually has a pump body that moves back and forth in a pump chamber, wherein the frequency of the pump body is rigidly coupled to the speed of the internal combustion engine. So that the delivery quantity to the second fuel pump can be controlled despite the rigid coupling of the pump body to the speed of the internal combustion engine, a control valve that controls the delivery quantity can be provided between the first fuel pump and the second fuel pump, and during a compression stroke of the pump body, this control valve permits part of the fuel from the pump chamber to flow back into the fuel connection between the first fuel pump and the second fuel pump. So that no vapor bubbles are produced inside the spaces that contain fuel, it is important that the control valve have a sufficiently large through flow cross section.

Because the through flow cross section must be relatively large, it has not been possible up to this point to construct the control valve so that the control valve switches rapidly enough to attain a sufficiently precise control or regulation of the pressure in the pressure line leading to the fuel valves even if the pump body has a high frequency.

Another disadvantage up to this point has been the fact that due to the size of the control valve, a relatively long time passes before the through flow cross section of the control valve is completely closed or completely opened so that in this transition time for the switching of the control valve, part of the fuel flows from the pump chamber of the second fuel pump into the fuel connection at a relatively high pressure, which involves a dissipation and consequently an undesirable energy loss and an undesirable heating of the fuel.

Despite the high cost, it has not previously been possible with sufficient precision to regulate or control the fuel quantity supplied by the second fuel pump even at high speeds of the internal combustion engine and to simultaneously assure that no gas bubbles are produced in the second fuel pump and that the second fuel pump does not require any excess fuel which likewise involves dissipation and consequently, further energy loss and heating of the fuel.

ADVANTAGES OF THE INVENTION

The fuel delivery system according to the invention, offers the exceptional feature that the electromagnet of the actuating drive that adjusts the valve member is supplied with current at an intermediate value while the control valve is still disposed in the starting position, i.e. for a certain amount of time before the valve member must be adjusted by the actuating drive, wherein the intermediate value of the current supply is at a level between the first value provided for the starting position and the second value provided for the end position. As a result, the valve member of the control valve does in fact remain in the starting position until the provided switching time, but subsequently, only a slight change in the current supply of the electromagnet is required to move the valve member from the starting position, which can occur within an extremely short period of time so that the valve member and therefore the control valve can be advantageously switched into the provided new end position in an extremely rapid fashion.

Advantageous improvements and updates of the fuel delivery system according are possible through the measures taken hereinafter.

While the valve member is still disposed in the starting position, i.e. for a certain amount of time before the control valve is to be actuated, the electromagnet of the actuating drive, which adjusts the valve member, is supplied with the current of an intermediate value that is adapted in a correspondingly different manner as a function of an operating condition of the internal combustion engine. As a function of a pressure inside the fuel delivery system, in particular as a function of a dynamic pressure acting on the valve member and/or as a function of time, in particular as a function of the momentary position of the pump body and/or as a function of a pump speed, then this achieves the advantage that, in a manner appropriate to the situation, the electromagnet produces just enough force that the valve member remains in its starting position. Only a slight change in the current supply must be carried out to move the valve member out of the starting position, which can occur within an extremely short period of time so that the control valve can be switched into the end position in an extremely rapid fashion.

By closing the through flow cross section as a function of an operating condition of the internal combustion engine, the fuel quantity supplied by the second fuel pump can be very simply and very precisely controlled or regulated with little dissipation. The control valve embodied according to the invention can be closed and opened in a particularly rapid and precisely timed fashion.

Through the use of the check valve that is hydraulically parallel to the control valve and conveys fuel from the fuel connection into the pump chamber of the second fuel pump, during an intake stroke, fuel can also travel from the fuel connection into the pump chamber in such a way that the fuel bypasses the control valve. This offers the adage that the through flow cross section of the control valve can be embodied as smaller without having to fear that during an intake stroke, the pressure in the pump chamber will drop too sharply and therefore result in the danger of gas bubbles.

If the control valve is embodied as a so-called seat valve, then a relatively large through flow cross section can advantageously be controlled or opened and closed with a relatively small adjustment path of the valve member.

BRIEF DESCRIPTION OF THE DRAWINGS

Selected, particularly advantageous exemplary embodiments of the invention are shown in a simplified fashion in the drawings and will be explained in detail in the subsequent FIG. 1 symbolically depicts a preferably selected advantageous exemplary embodiment of a fuel delivery system

DESCRIPTION OF THE EXEMPLARY EMBODIMENTS

Figure 1:
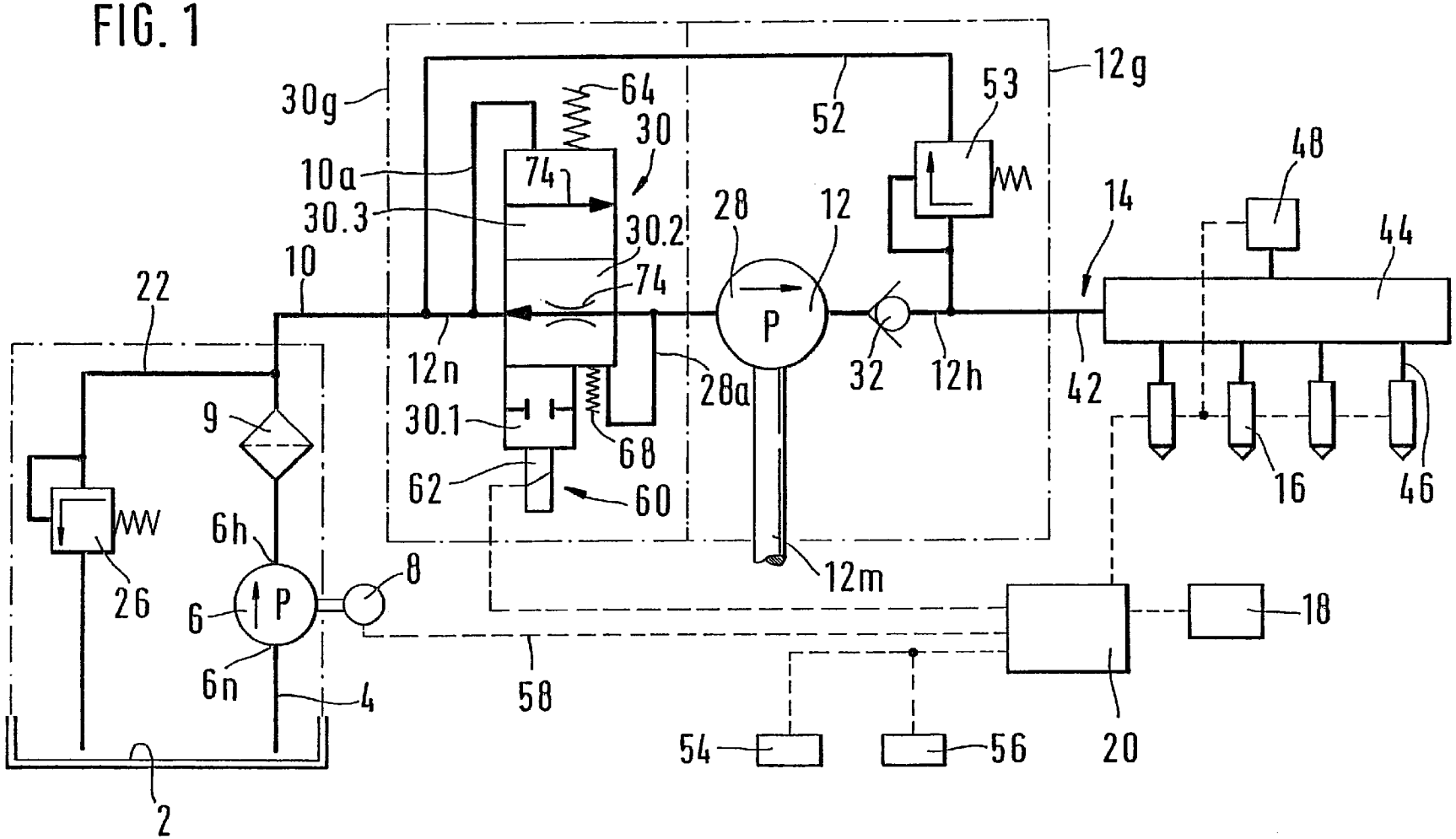

The fuel delivery system according to the invention for metering fuel for an internal combustion engine can be used in various types of internal combustion engines. A spark ignition fuel, in particular gasoline, is preferably used as the fuel. The internal combustion engine is for example a spark-ignition engine with external or internal mixture formation and externally supplied ignition, wherein the engine can be provided with a reciprocating piston (reciprocating piston engine) or with a rotatably supported piston (rotary piston engine). The ignition of the fuel-air mixture usually takes place by means of a spark plug. For example, the internal combustion engine is a hybrid engine. In this engine, which has charge stratification, the fuel-air mixture in the combustion chamber is enriched in the vicinity of the spark plug to such an extent that a reliable ignition is assured; the combustion in the middle, however, takes place with a very lean mixture.

The gas exchange in the combustion chamber of the internal combustion engine can, for example, take place according to the four-stroke process or according to the two-stroke process. In order to control the gas exchange in the combustion chamber of the internal combustion engine, gas exchange valves (inlet valves and outlet valves) can be provided in a known manner. The internal combustion engine can be embodied so that at least one fuel valve injects the fuel directly into the combustion chamber of an internal combustion engine. Depending on the operating mode, the control of the output of the internal combustion engine takes place by controlling the quantity of fuel supplied to the combustion chamber. However, there is also an operating mode in which the air supplied for the combustion of the fuel in the combustion chamber is controlled with a throttle valve. The power to be output by the internal combustion engine can also be controlled through the position of the throttle valve.

For example, the internal combustion engine has one cylinder with a piston, or it can be provided with a number of cylinders with a corresponding number of pistons. Preferably, a fuel valve is provided for each cylinder.

In order for the description not to be needlessly extensive, the following description of the exemplary embodiments is limited to a reciprocating piston engine with four cylinders as the internal combustion engine, wherein the four fuel valves inject the fuel, usually gasoline, directly into the combustion chamber of the internal combustion engine. The ignition of the fuel in the combustion chamber takes place by means of a spark plug. Depending on the operating mode, the output of the internal combustion engine can be controlled by controlling the injected fuel quantity or by a throttling of the incoming air. When idling or at a lower partial load, a charge stratification takes place, with an enrichment of the fuel-air mixture in the vicinity of the spark plug. In this instance, the mixture is very lean outside this region around the spark plug. At full load or at an upper partial load, a homogeneous distribution between fuel and air is sought in the entire combustion chamber.

FIG. 1 shows a fuel tank 2, an intake line 4, a first fuel pump 6, an electric motor 8, a filter 9, a fuel connection 10, a second fuel pump 12, a pressure line 14, four fuel valves 16, an energy supply unit 18, and an electric or electronic control unit 20. The fuel valves 16 are frequently referred to in professional circles as injection valves or injectors.

The first fuel pump 6 has a pressure side **6*h* and a suction side 6*n*. The second fuel pump 12 has a high pressure side 12*h* and a low pressure side 12*n*. The fuel connection 10 leads from the pressure side 6*h* of the first fuel pump 6 to the low pressure side 12*n* of the second fuel pump 12. A fuel line 22 branches from the fuel connection 10. Fuel can be conveyed from the fuel connection 10 directly back into the fuel tank 2 by way of the fuel line 22. A pressure regulating valve or pressure control valve 26 is provided in the fuel line 22. The pressure control valve 26 operates as a pressure limiting valve or a differential pressure valve; the pressure control valve ensures that a largely constant supply pressure prevails in the fuel connection 10, independent of how much fuel the second fuel pump 12 withdraws from the fuel connection 10. The pressure control valve 26** regulates the supply pressure, for example to 3 bar, which corresponds to 300 kPa.

The first fuel pump 6 is driven by the electric motor 8. The first fuel pump 6, the electric motor 8, and the pressure control valve 26 are disposed in the vicinity of the fuel tank 2. These parts are disposed, for example, outside the fuel tank 2 or are disposed inside the fuel tank 2, which is symbolically depicted by means of a dot-and-dash line.

The second fuel pump 12 is mechanically coupled to a drive shaft, not shown, of the internal combustion engine by way of a mechanical transmission means **12*m*. Since the second fuel pump 12 is coupled to the drive shaft of the internal combustion engine in a mechanically rigid fashion, the second fuel pump 12** operates purely proportional to the speed of the drive shaft of the internal combustion engine. The speed of the drive shaft varies widely in accordance with the instantaneous operating condition of the internal combustion engine. For example, the drive shaft is a cam shaft of the internal combustion engine.

The second fuel pump 12 has a pump chamber 28. A control valve 30 is disposed in the fuel connection 10, on the low pressure side **12*n* of the second fuel pump 12, on the inlet end of the pump chamber 28. The control valve 30 is used essentially to control the quantity of fuel to be supplied to and by the second fuel pump 12, which is why the control valve 30 can be referred to as a quantity control valve. This will be explained in more detail below. An outlet-end one way check valve 32 is provided in the pressure line 14, on the high pressure side 12*h* of the second fuel pump 12**.

The second fuel pump 12 is disposed inside a housing **12*g*, which is symbolically indicated with dot-and-dash lines. The check valve 32 can also be disposed inside the housing 12*g*. The control valve 30 has a valve housing 30*g*. The valve housing 30*g* is flange-mounted to the housing 12*g* or is integrated into the housing 12*g*. The control valve 30 can also be built directly into the housing 12*g***.

The pressure line 14 leading from the second fuel pump 12 to the fuel valves 16 can for the sake of simplicity be divided into a line section 42, a storage chamber 44, and distribution lines 46. The fuel valves 16 are each connected to the storage chamber 44 by means of a distribution line 46.

A pressure sensor 48 is connected to the storage chamber 44 and senses the respective pressure of the fuel in the pressure line 14. In accordance with this pressure, the pressure sensor 48 sends an electric signal to the control unit 20.

If the pressure of the fuel in the pressure line 14 is too high, then fuel is conveyed from the pressure line 14 into the fuel connection 10 by way of a return line 52. A pressure relief valve 53 is disposed in the return line 52. The pressure relief valve 53 ensures that the pressure of the fuel in the pressure line 14 cannot exceed a particular maximal value even if, due to some defect, the second fuel pump 12 pumps an undesirably excessive amount of fuel into the pressure line 14.

The fuel supply system also includes a sensor 54 or a number of sensors 54 and an accelerator pedal sensor 56. The sensors 54, 56 sense the operating condition in which the internal combustion is currently operating. The operating condition for the internal combustion engine can be composed of a number of individual operating conditions. For example, the individual operating conditions include: temperature and/or pressure of the fuel in the fuel connection 10, temperature and/or pressure of the fuel in the pressure line 14, air temperature, cooling water temperature, oil temperature, engine speed of the internal combustion engine or speed of the drive shaft of the internal combustion engine, composition of the exhaust of the internal combustion engine, injection time of the fuel valves 16, etc. The accelerator pedal sensor 56 is disposed in the vicinity of the accelerator pedal and, as another individual operating condition, detects the position of the accelerator pedal and therefore the speed desired by the driver.

The electric motor 8, the fuel valves 16, the pressure sensor 48, and the sensors 54, 56 are connected to the control unit 20 by means of electrical lines 58. The electrical line 58 between the fuel valves 16 and the control unit 20 is embodied so that the control unit 20 can control any of the fuel valves 16 separately. In order to differentiate them more clearly from the other, non-electrical lines, the electrical lines 58 are depicted with dashed lines.

For example, the first fuel pump 6 is a robust, easy-to-manufacture displacement pump, which essentially supplies a particular, constant quantity of fuel.

The pressure of the fuel in the fuel connection 10 on the pressure side 6*h* of the first fuel pump 6 is referred to as the supply pressure. In the fuel delivery system proposed, the pressure control valve 26 determines the supply pressure in the fuel connection 10.

The second fuel pump 12 supplies the fuel from the fuel connection 10, through the control valve 30, into the pump chamber 28 and from the pump chamber 28, through the outlet-side check valve 32, into the pressure line 14.

During the normal operating state, the pressure in the pressure line 14 can, for example, be approximately 100 bar, which corresponds to 10 MPa. It is therefore important to ensure that the second fuel pump 12 precisely pumps the instantaneously required fuel quantity into the pressure line 14 so that as little fuel as possible has to be conveyed out of the pressure line 14 back into the low pressure region of the fuel delivery system, which would involve very undesirable, unnecessary dissipation.

The control valve 30 symbolically depicted in FIG. 1 can be switched into a first valve position 30.1, a second valve position 30.2, and a third valve position 30.3. The symbolically depicted valve positions 30.1, 30.2, 30.3 are shown as different sizes only for the sake of better visibility.

Figure 2:
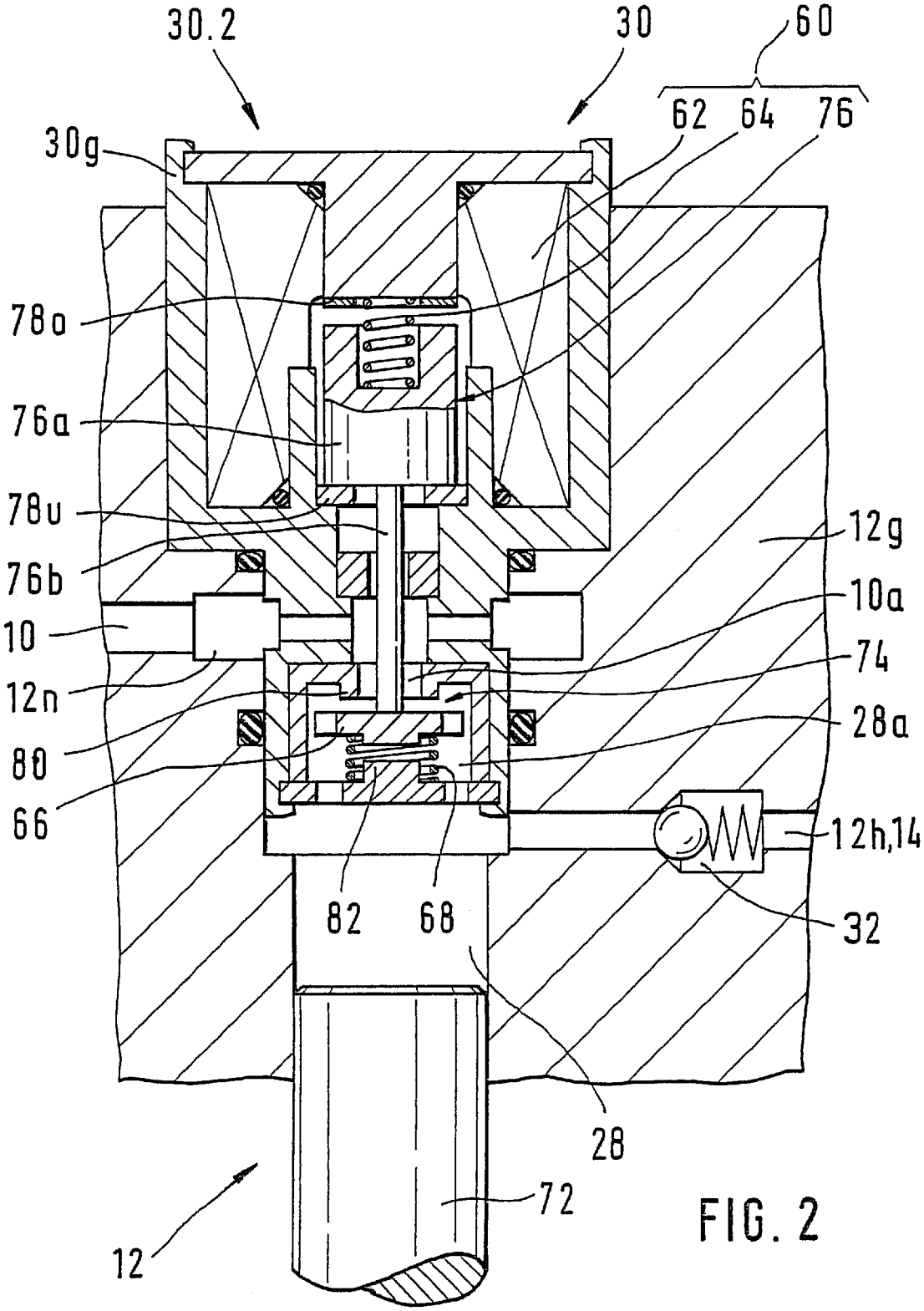
FIG. 2 shows a detail of the exemplary embodiment of a control valve

The control valve 30 has an actuating drive 60. The actuating drive 60 essentially includes an electromagnet 62 and a spring 64 that acts in opposition to the magnetic force of the electromagnet 62. By means of supplying current to the electromagnet 62 or not supplying current to the eletromagnet, the control valve 30 is switched into the first valve position 30.1 or into the second valve position 30.2. The control valve 30 has a valve member 66 (FIG. 2). The valve member 66 can be actuated counter to the force of a contacting spring 68 by the flow of fuel passing through the control valve 30. When fuel is flowing from the fuel connection 10 into the pump chamber 28 of the second fuel pump 12, i.e. when the pressure in the fuel connection 10 is greater than the pressure in the pump chamber 28, the valve member 66 (FIG. 2) is moved by the flow of fuel counter to the force of a contacting spring 68 so that the control valve 30 is disposed in the third valve position 30.3 depicted symbolically in FIG. 1. If the pressure in the pump chamber 28 is greater than in the fuel connection 10, then the fuel flows from the pump chamber 28 back into the fuel connection 10 and the valve member 66 is moved so that the control valve 30 is disposed in the second valve position 30.2 symbolically depicted in FIG. 1. The contacting spring 68 also assures that the valve member 66 (FIG. 2) can carry out the actuating motion produced by the actuating drive 60 and the control valve 30 can move into the first valve position 30.1. In order to graphically depict the fact that the control valve 30 can be switched between the two valve positions 30.2 and 30.3 in a pressure-dependent manner, two control lines or control chambers 10*a* and 28*a* are symbolically depicted in FIG. 1.

In the first valve position 30.1, a through flow cross section 74 between the fuel connection 10 and the pump chamber 28 is closed. In the second valve position 30.2, the control valve 30 has only slightly opened the through flow cross section 74 and the fuel can flow from the pump chamber 28 back into the fuel connection 10 with a certain throttling. In the third valve position 30.3, the control valve 30 has opened the through flow cross section 74 wide, and the fuel can flow from the fuel connection 10 into the pump chamber 28 in a largely unthrottled manner.

The second fuel pump 12 is designed so that the pump chamber 28 alternately expands and contracts while the internal combustion engine drives the second fuel pump 12 by way of the transmission means 12*m*. The pump chamber 28 expands and contracts, for example by virtue of the fact that a pump body 72 (FIG. 2) supported in the housing 12*g* is driven into an axial reciprocating motion by way of the mechanical transmission means 12*m*. During an intake stroke of the second fuel pump 12, i.e. when the pump body 72 is traveling downward (in relation to FIG. 2), the pump chamber 28 expands. During a compression stroke, i.e. when the pump body 72 is being pushed upward (in relation to FIG. 2), the pump chamber 28 contracts.

During an intake stroke during which the pump chamber 28 expands, the electromagnet 62 is not supplied with current and the fuel flowing from the fuel connection 10 into the pump chamber 28 moves the valve member 66 (FIG. 2) so that the control valve 30 is disposed in the third valve position 30.3 (FIG. 1), by means of which the through flow cross section 74 of the control valve 30 is opened wide and the fuel can flow from the fuel connection 10 into the pump chamber 28 in a largely unthrottled manner. In an average operating condition of the internal combustion engine, in the subsequent compression stroke during which the pump chamber 28 contracts, the electromagnet 62 is not initially supplied with current and the control valve 30 is disposed in its second valve position 30.2. As long as the control valve 30 is disposed in the valve position 30.2, the second fuel pump 12 pushes the fuel out of the pump chamber 28, through the control valve 30, and back into the fuel connection 10. Depending on the instantaneous operating condition of the internal combustion engine, particularly depending on the pressure that is sensed by the pressure sensor 48 in the pressure line 14 and depending on how much fuel the fuel valves 16 are currently intended to inject into the combustion chambers of the internal combustion engine, the control unit 20 calculates the time at which the through flow cross section 74 of the control valve 30 should be closed. In order to close the through flow cross section 74, the electromagnet 62 is supplied with current and the control valve 30 is switched into its first valve position 30.1. Since the control valve 30 was previously disposed in its second valve position 30.2 in which the through flow cross section 74 is not maximally opened, the distance which the valve member 66 (FIG. 2) must travel in order to close the through flow cross section 74 is only relatively short so that by means of this alone, the closing of the through flow cross section 74 can occur in a relatively rapid fashion. In particular in order to be able to achieve a very precise regulation of the pressure in the pressure line 14, it is important that the through flow cross section 74 can be closed and opened very rapidly. As a result, it is possible to also use a very rapidly functioning second fuel pump 12 in which the pump body 72 is moved back and forth very rapidly so that the pump chamber 28 expands and contracts very rapidly. Because the times for the intake stroke and compression stroke are very short with a rapidly functioning pump body 72 (FIG. 2), it is important that the control valve 30 opens and closes the through flow cross section 74 rapidly and precisely. The quantity of fuel per compression stroke which the second fuel pump delivers from the fuel connection 10 into the pressure line 14 can be determined by selecting the time during a compression stroke at which the control valve 30 is switched from the second valve position 30.2 into the first valve position 30.1.

In an exemplary form, FIG. 2 shows a detail from the first exemplary embodiment. The parts not shown in FIG. 2 correspond to those depicted in the remaining Figs. FIG. 2 essentially depicts a longitudinal section through the control valve 30, which is disposed in the unactuated switched position 30.2. The switched position 30.2 can also be referred to as the starting position.

In all of the Figs., parts which are the same or which function in the same manner are provided with the same reference numerals. Provided that nothing to the contrary is mentioned or shown in the drawings, that which is mentioned and shown in conjunction with one of the Figs. also applies to the other exemplary embodiments. Provided that nothing to the contrary is mentioned in the explanations, the details of the different exemplary embodiments can be combined with one another.

In addition to the electromagnet 62 and the spring 64, the actuating drive 60 also has an actuating body 76. The actuating body 76 is composed of an armature 76*a* and a tappet 76*b* connected to the armature 76*a*. When the electromagnet 62 is not supplied with current, the spring 64 presses the actuating body 76 downward (in relation to FIG. 2) into the starting position until the armature 76*a* comes to rest against a lower stopping disk 78*u* provided on the valve housing 30*g*. When the electromagnet 62 is supplied with a sufficiently intense current, the adjusting body 76 is actuated upward (FIG. 2) counter to the force of the spring 64 into an end position until the armature 76*a* comes to rest against an upper stopping disk 78*o* provided on the valve housing 30*g*.

A valve seat 80 is provided on the valve housing 30*g*. When the electromagnet 62 is not supplied with current, the through flow cross section 74 passing between the valve seat 80 and the valve member 66 is opened to the degree shown in FIG. 2. FIG. 2 shows the control valve 30 in the second valve position 30.2 or in the starting position. In the second valve position 30.2, the distance between the valve seat 80 and the valve member 66 is relatively slight so that in order to switch into the first valve position 30.1 (FIG. 1) or into the end position, the adjusting body 76 only has to be moved very slightly upward (in relation to FIG. 2) until the valve member 66 comes into contact with the valve seat 80 to close the through flow cross section 74. As a result, the through flow cross section 74 can be closed rapidly. The closing of the through flow cross section 74 is encouraged by the increasing pressure in the pump chamber 28 during the compression stroke. As shown in FIG. 2, the pressure in the control chamber 10*a*, in which essentially the same supply pressure prevails as in the fuel connection 10, acts on the valve member 66 downward, in the opening direction and the pressure in the control chamber 28*a*, in which essentially the same pressure prevails as in the pump chamber 28, acts on the valve member 66 upward, in the closing direction.

During an intake stroke, the pump body 72 moves downward (in relation to FIG. 2). As a result, the pressure of the fuel and pump chamber 28 falls below the supply pressure of the fuel and the fuel connection 10. This pressure difference acts in a downward direction (FIG. 2) on the valve member 66, counter to the force of the contacting spring 68. The force of the contacting spring 68 is quite small so that even a small pressure difference between the fuel connection 10 and the pump chamber 28 hydraulically presses the valve member 66 downward (FIG. 2). Thereby the valve member 66 lift up from the actuating body 76 of the actuating drive 60. This lifting results in the fact that is the valve member 66, which is hydraulically acted upon by the pressure difference between the pump chamber 28 and the fuel connection 10, on the whole has only a small mass to be moved, which results in the advantage that even a small pressure difference moves the valve member 66. In other words, even a small pressure difference moves the valve member 66 downward (FIG. 2) or upward (FIG. 2) counter to the force of the contacting spring 68 until the valve member 66 comes into contact with the tappet 76*b* of the actuating body 76 or into contact with the valve seat 80. The valve member 66 can be lifted from the valve seat 80 or from the actuating body 76 until the valve member 66 comes into contact with a valve member stop 82 provided on the valve housing 30*g*.

In the exemplary embodiment shown in FIGS. 1 and 2, by supplying current to the electromagnet 62, the control valve 30 is moved into the first valve position 30.1 (FIG. 1), in which the through flow cross section 74 is closed. In contrast to this, in the exemplary embodiment explained below in conjunction with FIGS. 3 and 4, when the electromagnet 62 is supplied with current, the through flow cross section 74 is opened. In the exemplary embodiment shown in FIGS. 3 and 4, the directions of the magnetic force of the electromagnet 62 and the spring force of the spring 64 of the actuating drive 60 are reversed in relation to the exemplary embodiment shown in FIGS. 1 and 2.

Figure 3:
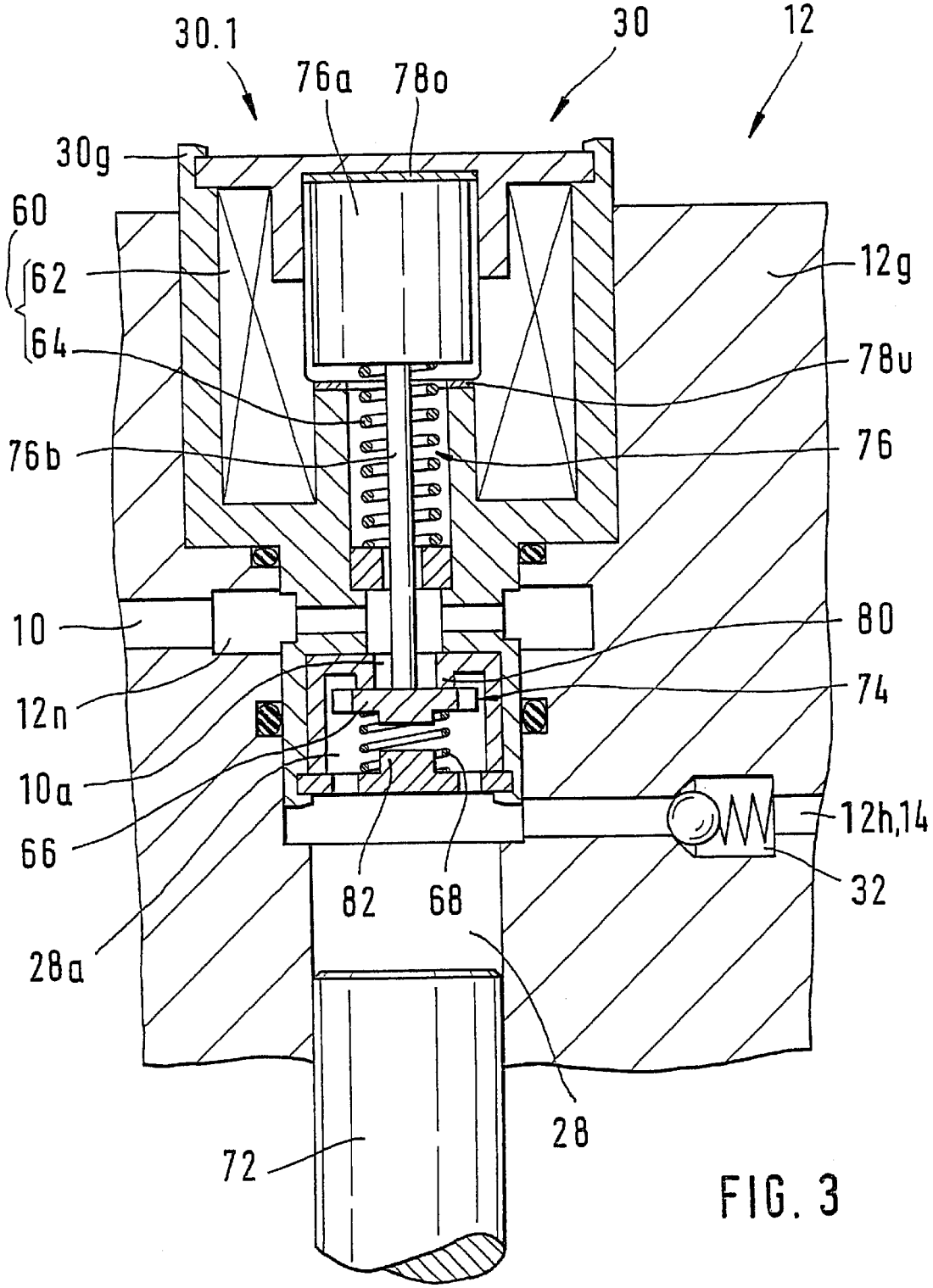
FIGS. 3 & 4 show a detail of another exemplary embodiment of a control valve FIG. 5 symbolically depicts another particularly advantageously embodied exemplary embodiment of a fuel delivery system
Figure 4:
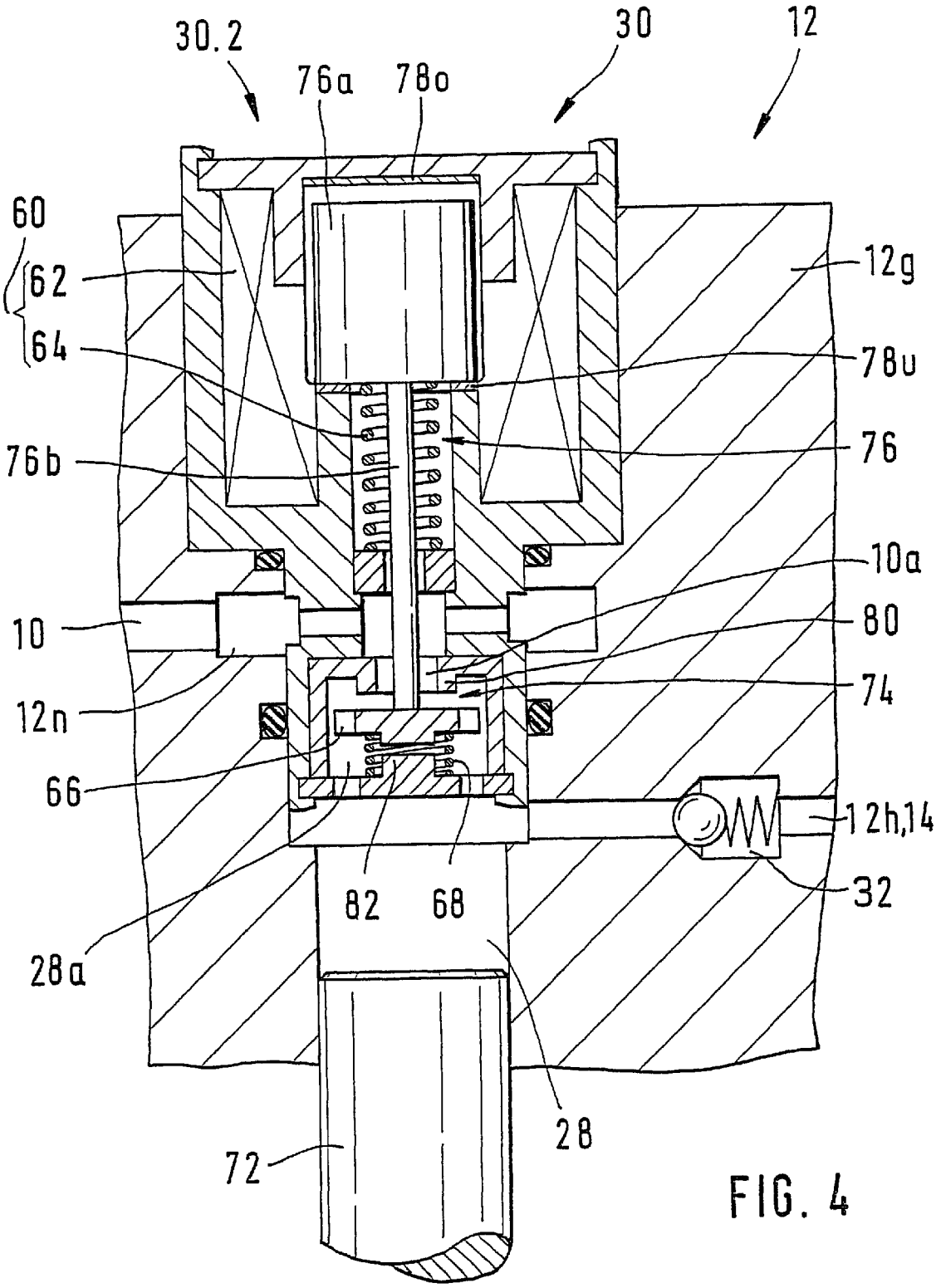

FIGS. 3 and 4 show another preferred, selected, particularly advantageous exemplary embodiment. FIG. 3 shows the exemplary embodiment when the electromagnet 62 is without current so that the control valve 30 is disposed in the first valve position 30.1 in which the through flow cross section 74 is closed. FIG. 4 shows the second exemplary embodiments when the electromagnet 62 is fully supplied with current as a result of which the control valve 30 is disposed in the second valve position 30.2.

When the pump chamber 28 in the exemplary embodiment shown in FIGS. 3 and 4 expands during an intake stroke, then the pressure in the pump chamber 28 drops and the fuel flows from the fuel connection 10, by way of the through flow cross section 74, into the pump chamber 28, wherein the fuel flowing through lifts the valve member 66 up from the valve seat 80. The through flow cross section 74 can thereby open completely so that the fuel can flow into the pump chamber 28 with very little pressure loss.

During the intake stroke, it is not absolutely necessary that the electromagnet 62 be supplied with current. However, the proposal is made to supply the electromagnet 62 with current at least toward the end of the intake stroke, at the latest shortly before the beginning of the compression stroke, so that the actuating body 76 is moved downward into the valve position 30.2 shown in FIG. 4. This assures that at the beginning of the compression stroke, the through flow cross section 74 is open so that the unneeded fuel in the pressure line 14 can flow back into the fuel connection 10. Because the valve member 66 rests against the actuating body 76 at the beginning of the compression stroke and there is only a small distance between the valve seat 80 and the valve member 66, the valve member 66 only has to travel a short distance in order to close the through flow cross section 74 so that the closing of the through flow cross section 74 can occur very rapidly. The through flow cross section 74 can be significantly smaller during the compression stroke than during the intake stroke.

Based on calculations, the control unit 20 determines the time during the compression stroke at which the supply of current to the electromagnet 62 is switched off, as a result of which the actuating body 76 is moved upward (in relation to FIGS. 3 and 4), and the valve member 66 closes the through flow cross section 74 by coming into contact with the valve seat 80. By switching off the supply of current to the electromagnet 62 of the actuating drive 60, the control valve 30 can be switched very rapidly during the compression stroke from the second valve position 30.2 shown in FIG. 4 into the first valve position 30.1 shown in FIG. 3. After the switch into the first valve position 30.1, the pump body 72 pushes the fuel out of the pump chamber 28, through the outlet-end check valve 32, into the pressure line 14. By varying the time at which the control valve 30 is switched, the quantity of fuel that is respectively required can be pumped into the pressure line 14 with a high degree of metering precision.

The fuel delivery system has a limp-home function that is described below: if the electromagnet 62 in the exemplary embodiment shown in FIGS. 3 and 4 malfunctions due to a defect or if its current supply is interrupted, then during the entire compression stroke, the valve member 66 is disposed in the position shown in FIG. 3 in which the through flow cross section 74 is closed so that the entire quantity of fuel displaced from the pump chamber 28 during the compression stroke is pumped into the pressure line 14 by way of the outlet-end check valve 32. During the intake stroke, the valve member 66 can also lift up from the valve seat 80 in the event of a malfunction of the electromagnet 62, as described above. If the electromagnet 62 of the actuating drive 60 malfunctions, the second fuel pump 12 can nevertheless pump, however without the possibility of a precise metering of the fuel quantity pumped into the pressure line 14. The excess partial quantity of fuel that is not required by the fuel valves 16 and is therefore not withdrawn thereby leads to a pressure increase in the pressure line 14 until the pressure relief valve 53 (FIG. 1) reacts and the unneeded fuel flows out of the pressure line 14, through the return line 52, and back into the fuel connection 10 or, in a modified embodiment, is conveyed back into the fuel tank 2. In the event of a malfunction of the electromagnet 62, the internal combustion engine can continue to operate with a limp-home function. As soon as the control unit 20 determines that the pressure sensor 48 is sensing a pressure that is higher than the pressure that would have to be produced due to the opening of the control valve 30, the control unit 20 recognizes that the limp-home function has begun. Because a precise metering of the fuel quantity that is fed into the pressure line 14 is not possible during the limp-home function, the proposal is made that the control unit 20 be embodied so that a corresponding malfunction message is displayed.

The switching time required for the switching of the control valve 30 can be significantly shortened by means of the following procedure when supplying current to the actuating drive 60. In the exemplary embodiment shown in FIGS. 1 and 2, the spring 64 must correspondingly be dimensioned so that the spring is strong enough that the spring can actuate the valve member 66 into the second valve position 30.2 shown in FIG. 2 and hold the valve in this position in all operating conditions that occur, i.e. at all pressures that occur in the fuel connection 10 and in the pump chamber 28 and at all flow velocities of the fuel through the through flow cross section 74. However, there are also operating conditions in which the entire force of the spring 64 is not needed to hold the valve member 66 in the second valve position 30.2. Subsequently, when the valve member 66 is intended to close the through flow cross section 74, in order for the switching from the starting position into the end position to be able to occur even more rapidly, the proposal is made that as long as the valve member 66 is intended to remain in the second valve position 30.2, which can also be referred to as the starting position, the electromagnet 62 is supplied with current until the force of the spring 64 minus the magnetic force of the electromagnet 62 is just enough to hold the valve member 66 securely in its starting position. If the time has come for the through flow cross section 74 to be closed, then a relatively small additional supply of current to the electromagnet 62 is sufficient to switch from the starting position into the end position. This small additional supply of current to the electromagnet 62 can occur in any significantly shorter period of time than if the electromagnet 62 had to be supplied with current starting from a completely currentless state.

The proposal is made that, before the movement of the control valve 30 from the starting position into the end position, the electromagnet be supplied with current of an intermediate value, wherein the intermediate value, with regard to its level, lies between the value that is provided for the starting position and the value that is provided for the end position.

A significant influence on the force necessary to hold the valve member 66 in the second valve position 30.2 is the pressure of the fuel in the pump chamber 28 when the fuel is being returned from the pump chamber 28 into the fuel connection 10. In this connection, the pressure in the pump chamber 28 is essentially a dynamic pressure. The dynamic pressure is predominantly determined by the flow velocity with which the fuel is displaced from the pump chamber 28 during the compression stroke. The dynamic pressure is essentially the pressure difference between the pressure on the side of the incoming fuel and the pressure on the side of the outgoing fuel of the valve member 66. In the exemplary embodiment shown, the dynamic pressure is essentially the pressure difference between the pressure in the control chamber 28*a* and the pressure in the is storage chamber 10*a*. The flow velocity depends on the velocity of the upward traveling pump body 27. The velocity of the pump body 72 is determined by the pump speed with which the fuel pump 12 is driven by the cam shaft. Therefore the proposal is made that an intermediate value for the current supply of the electromagnet 62 be selected as a function of the dynamic pressure acting on the valve member 66 in order then to only have to use a small additional supply of current to switch into the end position. Because the dynamic pressure depends on the velocity of the upward traveling pump body 72, which in turn corresponds to the pump speed, the proposal is made to determine the intermediate value as a function of the pump speed. Because the movement of the pump body 72 is mechanically coupled to the movement of the cam shaft of the internal combustion engine, the pump speed in turn depends directly on the engine speed of the internal combustion engine. The engine speed is usually measured for other reasons. In order to keep the total measurement cost as low as possible, instead of measuring the dynamic pressure directly, the proposal is made that the dynamic pressure be measured indirectly by way of the engine speed detection, which is possible without expenditure of any consequence.

If at the beginning of the compression stroke, the control valve 30 is disposed in the section valve position 30.2 and the through flow cross section 74 is open, then at a low pump speed, the dynamic pressure acting on the valve member 66 in the closing direction is lower than it is at a high pump speed. In order to hold the valve member 66 in the second valve position 30.2, the force of the actuating drive 60 in the opening direction must therefore be significantly greater at a high pump speed than at a low pump speed. In order to maintain as short a closing time as possible at all pump speeds, the proposal is made that the electromagnet 62 be initially supplied with current of a partial value for a period of time before the deliberate switching from the second valve position 30.2 (FIG. 2), i.e. from the starting position into the first valve position 30.1, i.e. into the end position, and in fact to supply the electromagnet with more current the lower the pump speed is.

Also in the exemplary embodiment shown in FIGS. 3 and 4, the switching time required for the switching of the control valve 30 can be further shortened to a significant degree. In this connection, the electromagnet 62 of the actuating drive 60 must be dimensioned as powerful enough that under all operating conditions, the electromagnet 62 can, if necessary, hold the valve member 66 in the second valve position 30.2 shown in FIG. 4 in which the through flow cross section 74 is open. The magnetic force of the electromagnet 62 necessary to hold the valve member 66, however, is lower in the majority of operating conditions. For the consideration of a switching process, the valve position 30.2 can be referred to as the starting position and the valve position 30.1 can be referred to as the end position. The proposal is made that in the operating conditions in which a lower magnetic force of the electromagnet 62 is sufficient to hold the valve member 66 in the starting position, the electromagnet 62 be correspondingly supplied with less current. If the intent is to subsequently close the through flow cross section 74 completely and the supply of current to the electromagnet is switched off for this purpose, then the magnetic force of the electromagnet 62 drops to zero significantly more rapidly and the spring 64 can actuate the actuating body 76 upward (FIG. 4) into the end position (FIG. 3) in a significantly more rapid fashion than if the electromagnet 62 were to be supplied with maximal current in the starting position (FIG. 4).

In order to maintain as short a switching time as possible at all pump speeds, the proposal is made that for a period of time before the deliberate switching from the second valve position 30.2 (FIG. 4), the starting position, into the first valve position 30.1 (FIG. 3) or into the end position, the electromagnet 62 be initially supplied with a slightly less intense current, in fact the less intensity the lower the pump speed.

Because the voltage of the electrical energy supply unit 18 (FIG. 1) is usually limited, from the beginning of the switching on of the electromagnet 62, it takes a certain amount of time until the electromagnet 62 can exert its full, maximal magnetic force on the actuating body 76. In the exemplary embodiment shown in FIGS. 3 and 4, when the magnetic force of the electromagnet 62 is switched off, the through flow cross section 74 is closed, wherein in particular the closing of the through flow cross section 74 is intended to occur in a particularly rapid fashion, within an extremely short period of time. Because it is possible to embody the control unit 20 so that the switching off of the magnetic force occurs more rapidly than the switching on of the magnetic force, in the exemplary embodiment shown in FIGS. 3 and 4, a particularly short closing time when closing the through flow cross section 74 is advantageously achieved because in this instance, the magnetic force of the electromagnet 62 must be switched off in order to close the through flow cross section 74. Therefore, with the second exemplary embodiment, the fuel quantity supplied by the second fuel pump 12 can be controlled somewhat more precisely.

Figure 5:
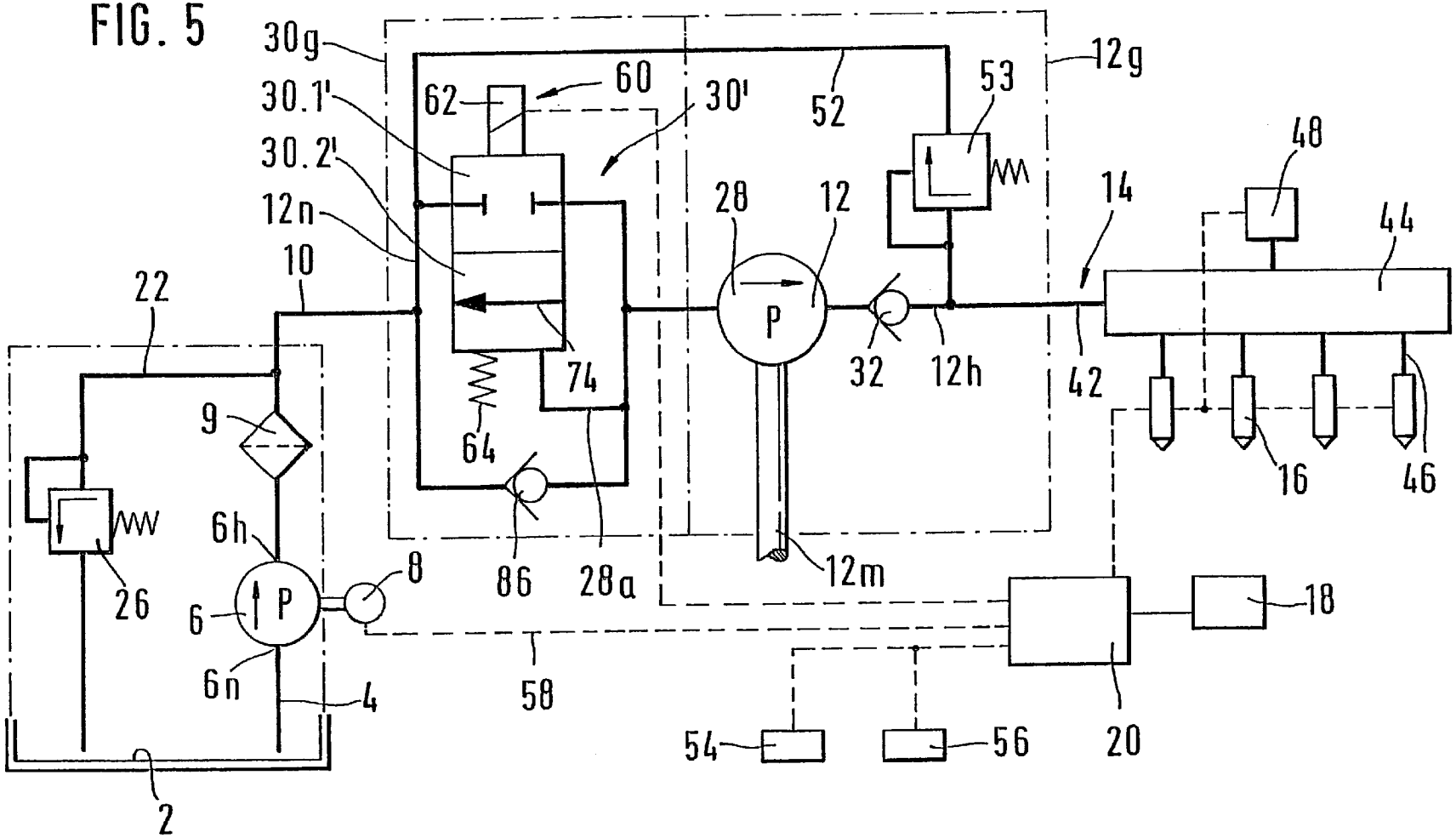

FIG. 5 symbolically depicts another exemplary embodiment. In this instance, a control valve 30' is used in lieu of the control valve 30 (FIG. 1). Except for the differences mentioned below, the control valve 30' is embodied in essentially the same fashion as the control valve 30. The control valve 30' has a first valve position 30.1' and a second valve position 30.2'. In the first valve position 30.1', fuel cannot flow from the pump chamber 28 back into the fuel connection 10. In the second valve position 30.2', the through flow cross section 74 is open so that the pump chamber 28 communicates with the fuel connection 10.

A check valve 86 is provided hydraulically parallel to the control valve 30'. During an intake stroke, fuel can also flow from the fuel connection 10, through the check valve 86, bypassing the control valve 30', and into the pump chamber 28 of the second fuel pump 12.

Figure 6:
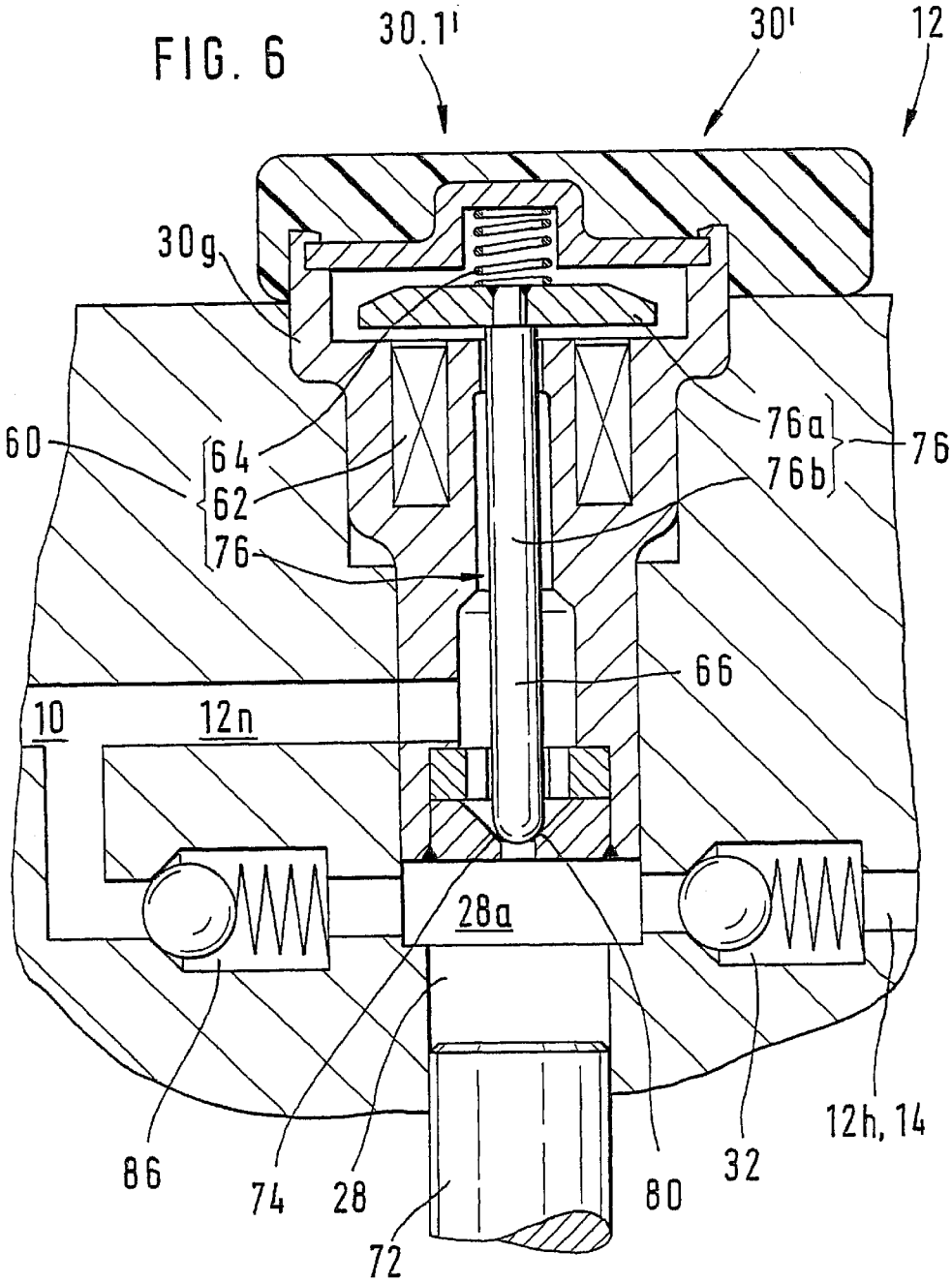
FIG. 6 shows a detail of the exemplary embodiment of a control valve according to FIG. 5, and FIGS. 7 & 8 show details of modified exemplary embodiments of control valve in the fuel delivery system.

FIG. 6 shows a detail from the exemplary embodiment depicted in FIG. 5. What is depicted is a longitudinal section through the control valve 30', which is disposed in the first valve position 30.1'.

During an intake stroke, the pump body 72 moves downward (in relation to the depiction in FIG. 6). In this connection, fuel flows from the fuel connection 10, through the check valve 86, and into the pump chamber 28. The check valve 86 is dimensioned so that it is large enough and, if there is a prestressed spring, so that this spring is a weak enough that even with a rapid intake motion of the pump body 72, the fuel can flow from the fuel connection 10 into the pump chamber 28 in a largely unthrottled manner. This assures that during an intake stroke, the pump chamber 28 is completely filled with fuel without gas bubbles.

Because during the intake stroke, the fuel can flow in a hydraulically parallel fashion past the control valve 30', no allowances have to be made for the intake stroke in the dimensioning of the through flow cross section 74 of the control valve 30' so that the through flow cross section 74 can be dimensioned as relatively small, which significantly facilitates a rapid actuation capacity of the control valve 30'.

The relatively weakly embodied spring 64 of the actuating drive 60 ensures that the valve member 66 is already actuated against the valve seat 80 during the intake stroke. This assures that the control valve 30' is closed already at the beginning of the compression stroke during which the pump body 72 is traveling upward, so that the electromagnet 62 does not have to work as hard as compared to an embodiment in which the electromagnet must close the through flow cross section of the control valve only during a compression stroke.

At the beginning of a compression stroke, the through flow cross section 74 is closed. During the compression stroke, the through flow cross section 74 is open. The time at which the through flow cross section 74 is opened depends on the fuel quantity which the second fuel pump 12 is intended to supply into the pressure line 14 by means of the outlet-end check valve 32.

The sum of the magnetic force of the electromagnet 62 and the spring force of the spring 64 yields a closing force. During the compression stroke, the closing force must be just great enough that the pressure of the fuel in the pump chamber 28 cannot lift the valve member 66 up from the valve seat 80. During the compression stroke, in order for the opening of the through flow cross section 74 to be able to occur very rapidly and exactly at the time calculated by the control unit 20, the proposal is made that the closing force be set as a function of the pressure in the pump chamber 28 so that the pressure is just strong enough that the valve member 66 does not unintentionally lift up from the valve seat 80. It is therefore proposed to excite the electromagnet 62 or to supply the electromagnet with current of an intermediate value that is strong enough that the valve member 66 does not lift up from the valve seat 80, wherein depending on the level of the pressure in the pump chamber 28, the intermediate value is less than the value of the current supply that is required in order to hold the valve member 66 against the valve seat 80 at the maximal pressure in the pump chamber 28, which current supply value, however, is also greater than the value of the current supply of the electromagnet 62 which is necessary for an open through flow cross section 74, wherein in the exemplary embodiment shown in FIG. 6, the value of the current supply of the electromagnet 62 for the open through flow cross section 74 is zero. If the first valve position 30.1' shown in FIG. 6 is considered to be a starting position, then during the compression stroke, as long as the through flow cross section 74 is intended to remain closed, the electromagnet 62 is supplied with current of an intermediate value, which lies between the maximal current supply of the electromagnet 62 and the minimal current supply required for the end position.

During the compression stroke, because the pressure of the fuel in the pressure chamber 28 is essentially approximately the same as the pressure of the fuel in the pressure line 14, the signal emitted by the pressure sensor 48 can also be used to determine the intermediate value of the current supply so that an additional pressure sensor is not required.

Figure 7:
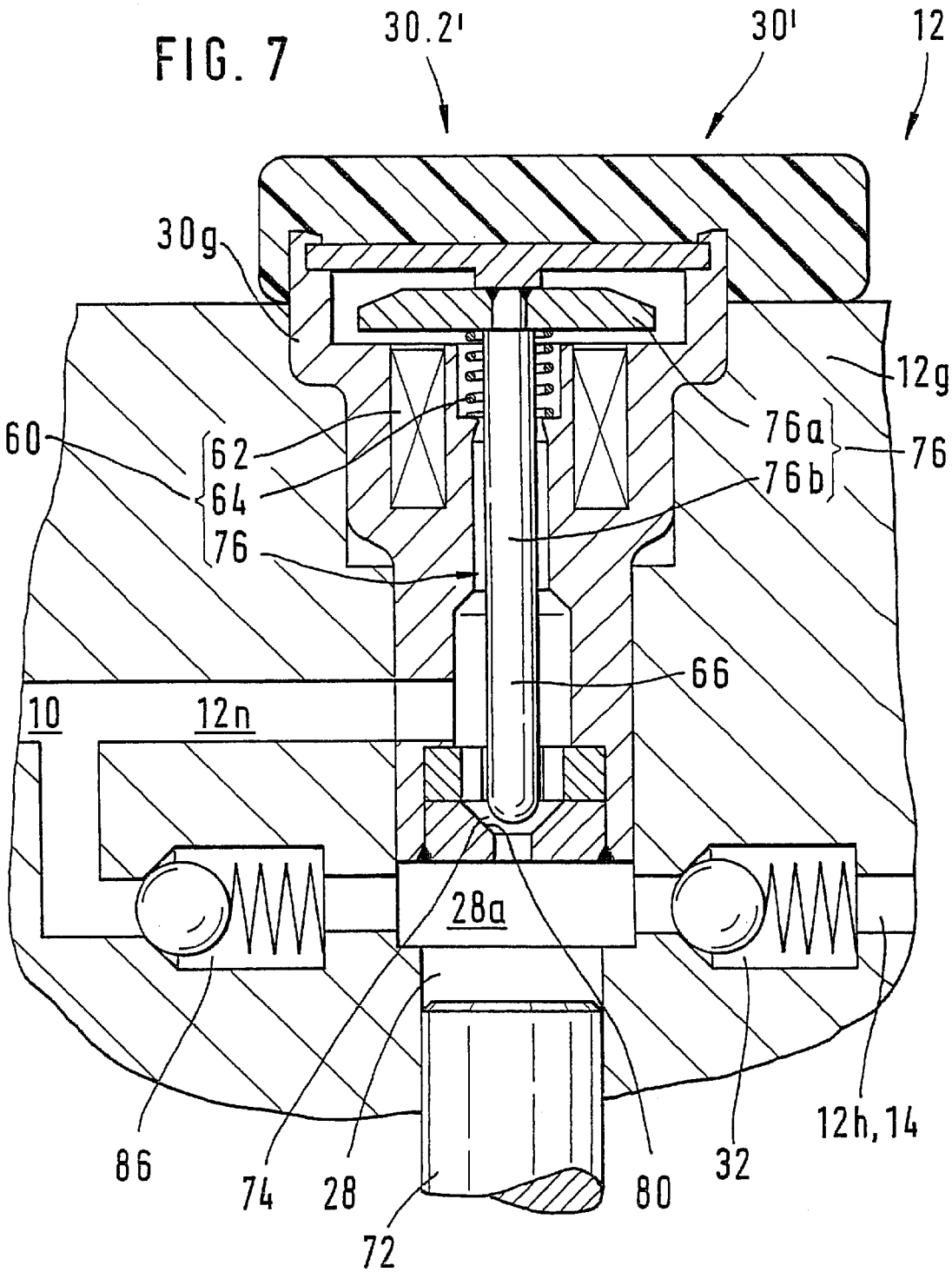

FIG. 7 shows another advantageous, preferably selected exemplary embodiment of a control valve.

In contrast to FIG. 6, in the exemplary embodiment shown in FIG. 7, the spring 64 acts in the opening direction.

The exemplary embodiment according to FIG. 7 has the advantage that during the intake stroke, a part of the fuel can flow through the through flow cross section 74 of the control valve 30' so that the check valve 86 is permitted to be smaller in dimension.

Figure 8:
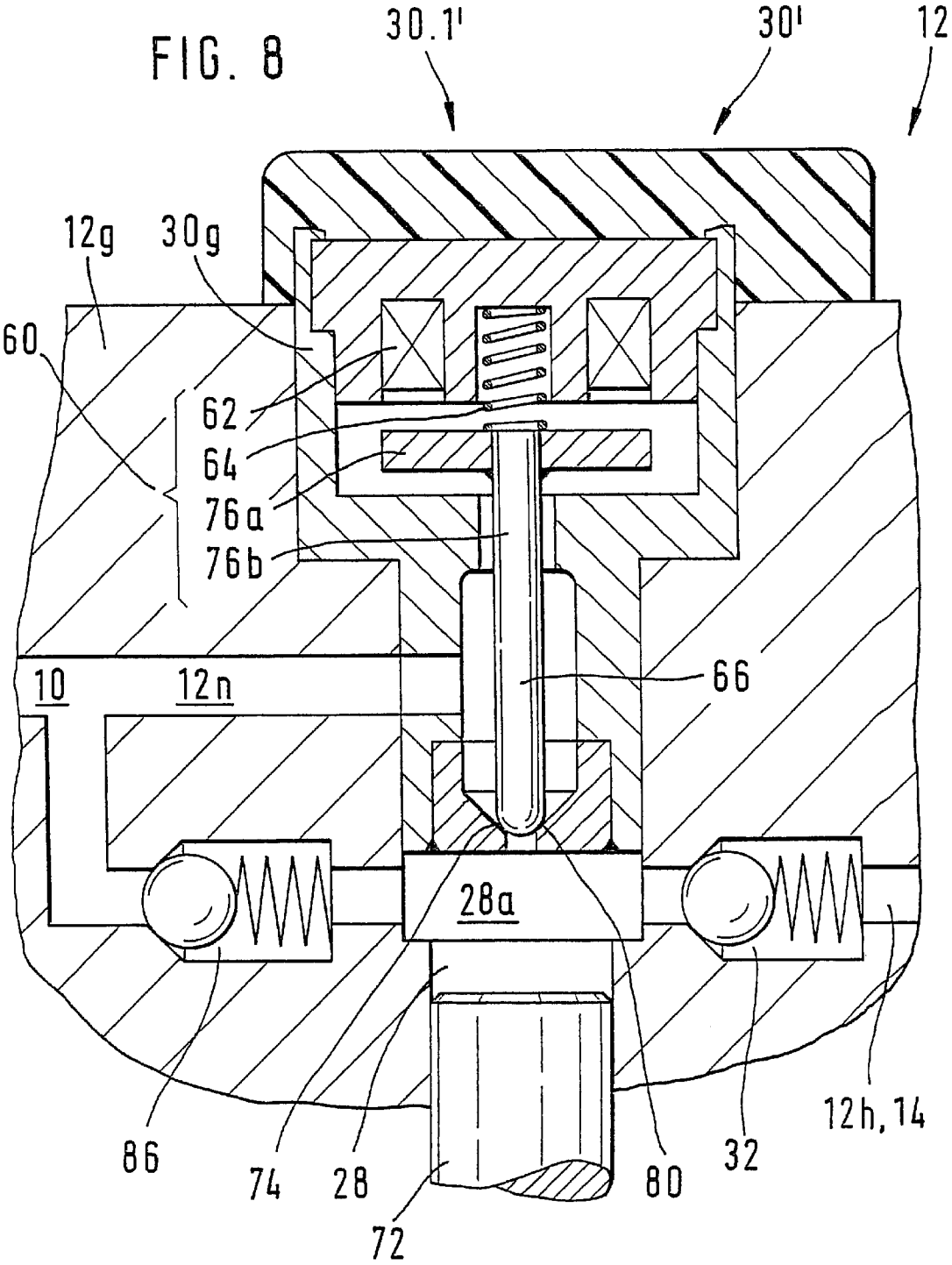

FIG. 8 shows another exemplary embodiment of a control valve.

In this exemplary embodiment, the spring 64 acts on the valve member 66 in the closing direction. The electromagnet 62 can actuate the valve member 66 in the opening direction. If the electromagnet 62 is not supplied with current, then the through flow cross section 74 is closed. The spring force of the spring 64 must be sufficiently dimensioned so that when the electromagnet 62 is not supplied with current, the through flow cross section 74 is closed under all operating conditions. In a majority of the operating conditions that occur, a weaker force would be sufficient to close the control valve 30'. It is therefore proposed that as long as the through flow cross section 74 is intended to remain closed, but at least shortly before the through flow cross section 74 is intended to be opened, the electromagnet 62 be already supplied with enough current that the closing force resulting from the spring force of the spring 64 minus the magnetic force of the electromagnet 62 at the instantaneous pressure prevailing in the pump chamber 28 is just sufficient to hold the valve member 66 against the valve seat 80.

The first valve position 30.1, 30.1' shown in FIGS. 3, 6, and 8, in which the through flow cross section 74 of the control valve 30, 30' is closed, can be referred to as the starting position and the second valve position 30.2, 30.2' shown in FIGS. 2, 4, and 7, in which the through flow cross section 74 is open, can be referred to as the end position. In order for the switching of the control valve 30, 30' from the starting position (FIG. 3, 6, 8) into the end position to occur as rapidly as possible, the electromagnet 62 should be supplied with just enough current that the valve member 66 remains in starting position until the calculated switching time. Then the valve member 66 can be moved into the end position by means of a slight change in the current supply of the electromagnet 62, which can occur very rapidly due to the slight change in the current supply and the slight change in the magnetic force.

However, the second valve position 30.2, 30.2' shown in FIGS. 2, 4, and 7, in which the through flow cross section 74 is open, can also be referred to as the starting position and the first valve position 30.1, 30.1' shown in FIGS. 3, 6, and 8, in which the through flow cross section 74 is closed, can also be referred to as the end position. In order for the switching of the valve member 66 from the second valve position 30.2, 30.2' into the first valve position 30.1, 30.1' to be able to occur in the shortest possible period of time, the proposal is made to supply the electromagnet 62 in the starting position with just enough current that the valve member 66 remains in this starting position and, at the provided time, the valve member 66 can then be switched into the end position by means of a slight change in the current supply of the electromagnet 62.

The control unit 20 can also be embodied so that the control unit can learn during the operation of the internal combustion engine and therefore the control of the internal combustion engine constantly improves. For example, when the electromagnet 62 is being supplied with current at the intermediate value, if the control unit 20 detects that the valve member 66 is not remaining in the starting position until the provided switching time, then in the next stroke of the pump body 72, the control unit 20 can change the intermediate value of the current supply of the electromagnet 62 so that the valve member 66 is assured of continuing to remain in the starting position. By approaching the optimal value for the intermediate value of the current supply of the electromagnet 62, the control unit 20 can optimize itself until the shortest possible switching time for closing or opening the control valve 30, 30' is achieved.

The foregoing relates to a preferred exemplary embodiments of the invention, it being understood that other variants and embodiments thereof are possible within the spirit and scope of the invention, the latter being defined by the appended claims.

What is claimed is:

1. A fuel delivery system for supplying fuel for an internal combustion engine, comprising a fuel tank (2), a first fuel pump (6), a second fuel pump (12), and a pressure line (14) to which at least one fuel injection valve (16) is connected, via which the fuel at least indirectly travels into a combustion chamber of the internal combustion engine, the first fuel pump (6) feeds the fuel from the fuel tank (2) into a fuel connection (10), and the second fuel pump (12) has a pump chamber (28) and essentially supplies the fuel from the fuel connection (10), through a control valve (30, 30') that has a changeable through flow cross section (74), into the pump chamber (28) and from the pump chamber (28) into the pressure line (14), wherein the control valve (30, 30') includes a valve member (66), which influences the through flow cross section (74), and includes an actuating drive (60), an electromagnet (62) moves the valve member (66), wherein the control valve (30, 30') is moved into a starting position by means of the electromagnet (62) being supplied with current at a first value and is moved into an end position by means of the electromagnet (62) being supplied with current at a second value, before the control valve (30, 30') is moved from the starting position into the end position, the electromagnet (62) is supplied with current of intermediate value, which lies between the first value and the second value.

2. The fuel delivery system according to claim 1, in which the current supply value of the starting position is zero.

3. The fuel delivery system according to claim 2, in which the actuating drive (60) for adjusting the actuating body (66) includes the electromagnet (62) and a spring (64) that acts in opposition to a magnetic force of the electromagnet (62), wherein the spring (64) moves the valve member (66) into the starting position.

4. The fuel delivery system according to claim 1, in which the current supply value of the end position is zero.

5. The fuel delivery system according to claim 4, in which the actuating drive (60) for adjusting the actuating body (66) includes the electromagnet (62) and a spring (64) that acts in opposition to the magnetic force of the electromagnet (62), wherein the spring (64) moves the valve member (66) into the end position.

6. The fuel delivery system according to claim 1, in which the intermediate value of the current supply of the electromagnet (62) depends on an operating condition of the internal combustion engine.

7. The fuel delivery system according to claim 3, in which the intermediate value of the current supply of the electromagnet (62) depends on an operating condition of the internal combustion engine.

8. The fuel delivery system according to claim 4, in which the intermediate value of the current supply of the electromagnet (62) depends on an operating condition of the internal combustion engine.

9. The fuel delivery system according to claim 1, in which the intermediate value of the current supply of the electromagnet (62) depends on a dynamic pressure acting on the valve member (66).

10. The fuel delivery system according to claim 4, in which the dynamic pressure is determined by means of detecting an engine speed of the internal combustion engine.

11. The fuel delivery system according to claim 1, in which the intermediate value of the current supply of the electromagnet (62) depends on a pressure prevailing in the pump chamber (28).

12. The fuel delivery system according to claim 1, in which the intermediate value of the current supply of the electromagnet (62) depends on a pressure prevailing in the pressure line (14).

13. The fuel delivery system according to claim 1, in which the intermediate value depends on a time remaining until the control valve (30) is switched from the starting position into the end position.

14. The fuel delivery system according to claim 1, in which a check valve (86), which conveys fuel from the fuel connection (10) into the pump chamber (28), is provided hydraulically parallel to the control valve (30, 30').

15. The fuel delivery system according to claim 3, in which a check valve (86), which conveys fuel from the fuel connection (10) into the pump chamber (28), is provided hydraulically parallel to the control valve (30, 30').

16. The fuel delivery system according to claim 5, in which a check valve (86), which conveys fuel from the fuel connection (10) into the pump chamber (28), is provided hydraulically parallel to the control valve (30, 30').

17. The fuel delivery system according to claim 6, in which a check valve (86), which conveys fuel from the fuel connection (10) into the pump chamber (28), is provided hydraulically parallel to the control valve (30, 30').

18. The fuel delivery system according to claim 1, in which the second fuel pump (12) has a pump body (72) that is driven, wherein the pump body (72) alternately expands and contracts the pump chamber (28) as a result of the pump body (72) being driven.

19. The fuel delivery system according to claim 3, in which the second fuel pump (12) has a pump body (72) that is driven, wherein the pump body (72) alternately expands and contracts the pump chamber (28) as a result of the pump body (72) being driven.

20. The fuel delivery system according to claim 1, in which the control valve (30, 30') is a seat valve.

* * * * *